US011038273B1

(12) United States Patent
Cai et al.

(10) Patent No.: US 11,038,273 B1
(45) Date of Patent: Jun. 15, 2021

(54) ELECTRONICALLY SCANNING ANTENNA ASSEMBLY

(71) Applicant: THE BOEING COMPANY, Chicago, IL (US)

(72) Inventors: Lixin Cai, Ravensdale, WA (US); Alec Adams, Seattle, WA (US); Manny Urcia, Wildwood, MO (US)

(73) Assignee: THE BOEING COMPANY, Chicago, IL (US)

( * ) Notice: Subject to any disclaimer, the term of this patent is extended or adjusted under 35 U.S.C. 154(b) by 0 days.

(21) Appl. No.: 16/826,338

(22) Filed: Mar. 23, 2020

(51) Int. Cl.
*H01Q 9/04* (2006.01)
*H01Q 21/06* (2006.01)
*H01Q 1/28* (2006.01)

(52) U.S. Cl.
CPC ..... *H01Q 9/0457* (2013.01); *H01Q 1/28* (2013.01); *H01Q 21/065* (2013.01)

(58) Field of Classification Search
CPC ..... H01Q 1/28; H01Q 9/0407; H01Q 9/0435; H01Q 9/045; H01Q 9/0457; H01Q 21/0006
See application file for complete search history.

(56) References Cited

U.S. PATENT DOCUMENTS 5,726,666 A * 3/1998 Hoover ..... H01Q 13/10 343/767
6,529,172 B2 * 3/2003 Zimmerman ..... H01Q 9/28 343/795
7,541,982 B2 * 6/2009 Gillette ..... H01Q 1/38 343/700 MS
7,619,568 B2 * 11/2009 Gillette ..... H01Q 1/38 343/700 MS
2001/0043157 A1 * 11/2001 Luk ..... H01Q 1/40 343/700 MS
2004/0095287 A1 * 5/2004 Mohamadi ..... H01Q 9/0457 343/824
2004/0263392 A1 * 12/2004 Bisiules ..... H01Q 9/0457 343/700 MS
2010/0103049 A1 * 4/2010 Tabakovic ..... H01Q 9/0457 343/700 MS
2012/0098706 A1 * 4/2012 Lin ..... H01Q 21/065 343/700 MS
2014/0184457 A1 * 7/2014 Lea ..... H01Q 1/50 343/747
2015/0022416 A1 * 1/2015 Sasaki ..... H01Q 23/00 343/841
2016/0248169 A1 * 8/2016 Mohammadian .... H01Q 21/065
2017/0179610 A1 * 6/2017 Watson ..... H01Q 9/0457
2019/0123443 A1 * 4/2019 Russell ..... H01Q 21/0025
(Continued)

OTHER PUBLICATIONS

R.J. Mailloux, "On the use of metallized cavities in printed slot arrays with dielectric substrates," IEEE Transactions on Antennas and Propagation, May 1987, pp. 477-487.
(Continued)

*Primary Examiner* — Jason Crawford
(74) *Attorney, Agent, or Firm* — The Small Patent Law Group LLC; Joseph M. Butscher

(57) ABSTRACT

An antenna assembly includes a base including one or more feed transitions, a support panel separated from the base, a patch secured to the support panel, and one or more T-shaped probes that couple the feed transition(s) to the patch. The T-shaped probe(s) are separated from the patch.

20 Claims, 5 Drawing Sheets

(56) References Cited

U.S. PATENT DOCUMENTS

| | | | | |
|---|---|---|---|---|
| 2019/0363454 | A1* | 11/2019 | Forati | H01P 5/12 |
| 2019/0393597 | A1* | 12/2019 | Kosaka | H01Q 5/10 |
| 2020/0220268 | A1* | 7/2020 | Kim | H01Q 21/28 |

OTHER PUBLICATIONS

G. Mayhew-Ridgers, J.W. Odendaal and J. Joubert, "Single-layer capacitive feed for wideband probe-fed microstrip antenna elements," IEEE Transactions on Antennas and Propagation, Jun. 2003, pp. 1405-1407.

N.K. Vishwakarma, et al., "Design considerations for a wide scan cavity backed patch antenna for active phased array radar," in Proc. IAW, Dec. 2011.

J.M.I. Alonso, M.S. Perez, "Phased array for UAS communications at 5.5GHz," IEEE Antennas and Wireless Propagation Letters, vol. 14, 2015, p. 771-774.

F. Cui, et al., "Design of a broadband cross-shaped patch antenna for phased array," in Proc. ICUWB, Oct. 2016.

* cited by examiner

ELECTRONICALLY SCANNING ANTENNA ASSEMBLY

FIELD OF EMBODIMENTS OF THE DISCLOSURE

Embodiments of the present disclosure generally relate to antenna assemblies, such as wideband electronically scanning antenna assemblies.

BACKGROUND OF THE DISCLOSURE

An antenna typically includes an array of conductors electrically connected to a receiver or a transmitter. The transmitter provides an electric current to terminals of the antenna, which in response radiates electromagnetic waves. Alternatively, as radio waves are received by the antenna, an electrical current is generated at the terminals, which in turn is applied to the receiver. Various types of known antennas are configured to transmit and receive radio waves with a reciprocal behavior.

In some aerospace applications, there is a need for antennas that are capable of being positioned on conformal or non-planar surfaces, such as wings and fuselages of aircraft. Small aircraft, such as unmanned aerial vehicles (UAVs) or drones, in particular, have surfaces with low radii of curvature. Such aircraft typically need light weight antennas with low aerodynamic drag and low visibility. Further, various surfaces of aircraft may be formed from conductive or carbon fiber materials, which are known to change the electrical behavior of antennas, such as monopole and dipole antennas and derivatives (for example, whip, blade, Yagi, and other such antennas).

Dish antennas are relatively large and may not be easily steerable. Certain dish antennas are coupled to gimbals, which allow for steering. However, dish antennas may be too large and bulky to be used with certain aircraft. For example, various dish antennas add substantial weight to aircraft, thereby reducing fuel efficiency. Further, the dish antennas may increase aerodynamic drag, due to their size and shape, which further reduces fuel efficiency and may also affect aircraft maneuverability.

As another example, certain antennas include relatively heavy and bulky slotted copper waveguide pipes, which form an aperture section of an electronically scanning antenna array system. Again though, the weight, size, and shape of such antennas may not be well-suited for aeronautical and aerospace applications, as such antennas may undesirably affect fuel efficiency and maneuverability. Further, the process of manufacturing such antennas is typically complex.

SUMMARY OF THE DISCLOSURE

A need exists for a compact and lightweight antenna assembly. Further, a need exists for an electronically steerable antenna assembly that can be effectively used with vehicles without reducing fuel efficiency and/or maneuverability.

With those needs in mind, certain embodiments of the present disclosure provide an antenna assembly that includes a base including one or more feed transitions, a support panel (such as a non-metallic support panel) separated from the base, a patch (such as a metallic patch) secured to the support panel, and one or more T-shaped probes (such as metallic T-shaped probes) that couple the feed transition(s) to the patch. The T-shaped probe(s) are separated from the patch. In at least one embodiment, the T-shaped probe(s) are separated from the support panel by a feed gap.

In at least one embodiment, the base, the support panel, and/or the patch are formed from one or more portions of one or more circuit boards.

In at least one embodiment, outer perimeter walls are disposed between the base and the support panel. An internal cavity (such as an internal metallic cavity) is defined between the outer perimeter walls, the base, and the support panel. The T-shaped probe(s) are disposed within the internal cavity. The outer perimeter walls may be formed from one or more portions of one or more circuit boards.

In at least one embodiment, one or more inner cross walls (such as non-metallic inner cross walls) are within the internal cavity. The T-shaped probe(s) are supported by the inner cross wall(s).

For example, the feed transitions include a first feed transition and a second feed transition. The T-shaped probes include a first T-shaped probe, a second T-shaped probe, a third T-shaped probe, and a fourth T-shaped probe. The inner cross walls include a first inner cross wall, a second inner cross wall, a third inner cross wall, and a fourth inner cross wall. The first T-shaped probe is connected to the first feed transition and the first inner cross wall. The second T-shaped probe is connected to the first feed transition and the second inner cross wall. The third T-shaped probe is connected to the second feed transition and the third inner cross wall. The fourth T-shaped probe is connected to the second feed transition and the fourth inner cross wall. The first inner cross wall may be parallel to the second inner cross wall. The third inner cross wall may be parallel to the fourth inner cross wall. The first and second inner cross walls may be orthogonal to the third and fourth inner cross walls.

In at least one embodiment, the patch is a microstrip patch supported on an upper surface of the support panel.

In at least one embodiment, the antenna assembly also includes a frame defining an internal opening. The the frame is coupled to the support panel. The frame may be formed from one or more portions of one or more circuit boards.

In at least one embodiment, the antenna assembly also includes one or more feed lines coupled to the base and connected to the one or more feed transitions. One or more vias extend through the base proximate to the feed line(s).

In at least one embodiment, the T-shaped probes include a foot secured within one of the feed transitions(s), an extension body connected to the foot, and an expanded head connected to the extension body opposite from the foot.

Certain embodiments of the present disclosure provide a method of forming an antenna assembly. The method includes providing a base including one or more feed transitions; separating a support panel from the base; securing a patch to the support panel; and coupling one or more T-shaped probes to the feed transition(s) and the patch. Said coupling includes separating the T-shaped probe(s) from the patch.

DETAILED DESCRIPTION OF THE DISCLOSURE

The foregoing summary, as well as the following detailed description of certain embodiments, will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

Certain embodiments of the present disclosure provide an antenna assembly, such as an electronically scanning antenna assembly. In at least one embodiment, the antenna assembly is formed of circuit board sections. A top section includes a layer of dielectric substrate that supports a patch, such as a microstrip patch, a square ring slot hybrid radiator, and a tuning square ring. A bottom section contains a metallic cavity formed by sidewalls. Cross walls support feed probes. A grounded dual layered dielectric substrate has an embedded stripline. The cavity suppresses backward radiation and reduces undesired mutual coupling with neighboring antenna elements. It has been found that such an antenna assembly exhibits improved radio frequency performance over bandwidth, has an ability to scan to at least sixty degrees from array broadside without onset of grating lobes, and provides dual linear polarizations and basis for circular polarizations.

Certain embodiments of the present disclosure provide an antenna assembly that is well suited for use with vehicles, such as aircraft. The antenna assembly allows for transmission and reception of radio frequency signals with an agile electronically scanning antenna array beam. In at least one embodiment, the antenna assembly has no moving parts. The antenna assembly can be used in radar and sensor systems, as well as other application including communications and electronic warfare.

Embodiments of the present disclosure provide a low-cost antenna assembly that is lightweight and has a low profile. In at least one embodiment, the antenna assembly is formed of lightweight and low-profile circuit board sections, which substantially reduce a weight and thickness of the antenna assembly, while at the same time maintaining desired performance.

Embodiments of the present disclosure provide an antenna assembly including one or more T-shaped probes that coupled a feed transition of a base to a patch secured to a support panel. The T-shaped probe(s) is/are disposed within an internal cavity of the antenna assembly. In at least one embodiment, a frame defining an internal opening is secured to the support panel, such as to below or over the support panel.

Figure 1:
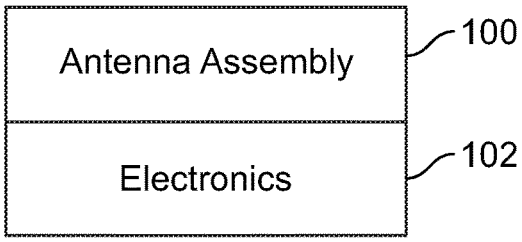
FIG. 1 illustrates a schematic block diagram of an antenna assembly coupled to electronics, according to an embodiment of the present disclosure.

FIG. 1 illustrates a schematic block diagram of an antenna assembly 100 coupled to electronics 102, according to an embodiment of the present disclosure. The electronics 102 allow a collimated beam, such as a radio frequency beam, to be steered or otherwise pointed from the antenna assembly 100 at desired directions. In at least one embodiment, the beam is steered from the antenna assembly 100, such as via the electronics 102, without any moving parts (such as a gimbal). The electronics 102 are programmed and configured to point the beam at various desired directions.

Figure 2:
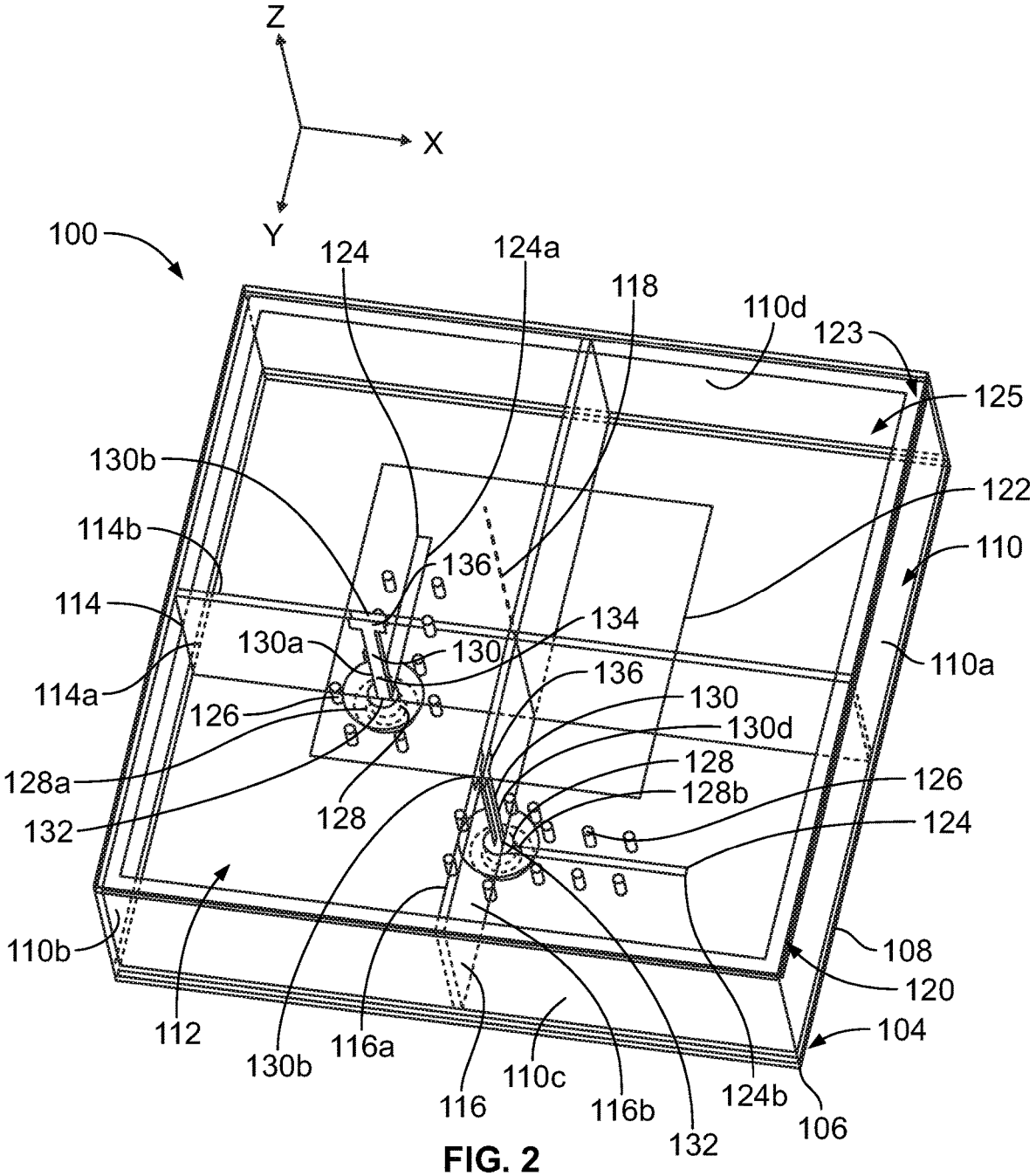
FIG. 2 illustrates a perspective top view of the antenna assembly, according to an embodiment of the present disclosure.

FIG. 2 illustrates a perspective top view of the antenna assembly 100, according to an embodiment of the present disclosure. For the sake of clarity, various components of the antenna assembly 100 are shown transparent in order for internal components to be seen. In at least one embodiment, the antenna assembly 100 includes components that are formed from at least portions of circuit boards. The antenna assembly 100 includes a base 104, which may be formed of one or more circuit boards, circuit board materials, and/or sections or portions of circuit boards. For example, the base 104 includes a first dielectric layer 106 that supports a second dielectric layer 108. That is, the second dielectric layer 108 overlays the first dielectric layer 106. Optionally, the base 104 may include more or less dielectric layers. For example, the base 104 can include only the first dielectric layer 106. As another example, the base 104 can include three or more dielectric layers. In at least one embodiment, the base 104 provides a ground plane for the antenna assembly 100.

Outer perimeter walls 110 extend from the base 104. As an example, the outer perimeter walls 110 include lateral walls 110*a* and 110*b* connected to end walls 110*c* and 110*d*. As shown, the lateral walls 110*a* and 110*b* and the end walls 110*c* and 110*d* upwardly extend from the base 104, thereby forming an internal cavity 112 therebetween. In at least one embodiment, the outer perimeter walls 110 are orthogonal to the base 104. For example, the base 104 resides in one or more planes that are parallel to an X-Y plane (such as horizontal plane), while the perimeter walls 110 reside in one or more planes that are parallel to a Y-Z plane (such as a vertical plane).

As shown, the outer perimeter walls 110 are disposed between the base 104 and a support panel 120. The internal cavity 112 is defined between the outer perimeter walls 110, the base 104, and the support panel 120. As described herein, one or more T-shaped probes 130 are disposed within the internal cavity 112.

Open spaces within the internal cavity 112 (such as those not occupied by structures, such as a cross wall) can be filled with air or foam, for example. The internal cavity 112 suppresses backward radiation. Further, the internal cavity 112 reduces undesired mutual coupling with neighboring antenna assemblies 100 (shown in FIG. 7).

In at least one embodiment, the outer perimeter walls 110 are formed of circuit boards, circuit board materials, and/or sections or portions of circuit boards. For example, the outer perimeter walls 110 are formed of non-etched circuit boards. As shown, the outer perimeter walls 110 provide a box-like perimeter extending from the base 104. Alternatively, the outer perimeter walls 110 may be sized and shaped differently than shown. For example, the outer perimeter walls 110 may be circular or otherwise arcuate, instead of flat, planar walls.

Inner cross walls 114 (such as first inner cross walls) extend from the base 104 within the internal cavity 112 between the lateral walls 110*a* and 110*b*. For example, two parallel inner cross walls 114 extend between the lateral walls 110*a* and 110*b*. The inner cross walls 114 reside in planes that are parallel to an X-Z plane. Like the outer perimeter walls 110, the inner cross walls 114 may be formed of circuit boards, circuit board materials, and/or sections or portions of circuit boards. Optionally, the antenna assembly 100 may include more or less inner cross walls 114 than shown. For example, the antenna assembly 100 may include three inner cross walls 114. As another example, the antenna assembly 100 may include only one inner cross wall 114.

Inner cross walls 116 (such as second inner cross walls) extend from the base 104 within the internal cavity 112 between the end walls 110*c* and 110*d*. For example, two parallel inner cross walls 116 extend between the end walls 110*c* and 110*d*. The inner cross walls 116 are orthogonal to the inner cross walls 114. The inner cross walls 116 reside in planes that are parallel to the Y-Z plane. The inner cross walls 116 may be formed of circuit boards, circuit board materials, and/or sections or portions of circuit boards. As shown, the inner cross walls 114 may intersect the inner cross walls 116 proximate to a central axis 118 of the antenna assembly 100. Optionally, the antenna assembly 100 may include more or less inner cross walls 116 than shown. For example, the antenna assembly 100 may include three inner cross walls 116. As another example, the antenna assembly 100 may include only one inner cross wall 116.

The support panel 120 (shown transparent) connects to upper edges of the outer perimeter walls 110 opposite from the base 104. The support panel 120 includes one or more dielectric substrates. In at least one embodiment, the support panel 120 is spaced apart from the base 104 by the outer perimeter walls 110, and is parallel to the base 104. For example, the support panel 120 resides in one or more planes that are parallel to the X-Y plane.

In at least one embodiment, the support panel 120 is a single dielectric layer. The support panel 120 supports a patch 122, such as a microstrip patch. For example, the patch 122 is supported on an upper surface of the support panel 120.

A frame 123 is coupled to the support panel 120. For example, the frame 123 extends below and around an outer perimeter of the support panel 120. The frame 123 may be formed of a metal. The frame 123 defines an internal opening 125 over the support panel 120. In at least one embodiment, the patch 122 is disposed within the internal opening 125. As shown, the frame 123 provides a ring, such as a square ring, defining the internal opening 125. In at least one embodiment, the frame 123 provides a cage that defines the internal opening 125 in which the patch 122 may be axially contained, such as within planes than are parallel to the X-Y plane. In at least one embodiment, the frame 123 may be formed of at least portions of a circuit board.

Optionally, the frame 123 can be disposed over the outer perimeter of the support panel 120. Also, optionally, a non-metallic environmental protective coating may be disposed over the antenna assembly 100.

The frame 123 provides a tuning mechanism for the patch/slot hybrid radiator formed by the patch 122 and the internal opening 125 (or ring slot). The patch 122 and internal opening 125 provide resonances that are configured to be close to each other in frequency, thereby allowing for an overall wide operating bandwidth.

Referring to FIGS. 1 and 2, the antenna assembly 100 includes one or more feed lines 124, such as the feed lines 124*a* and 124*b*, and a plurality of vias 126. In at least one embodiment, the feed lines 124 are striplines. The feed lines 124 are embedded within the base 104. Optionally, the feed lines 124 are coupled to an upper surface of the base 104. The vias 126 extend through the base 104 proximate the feed lines 124*a* and 124*b* (such as on sides of each of the feed lines 124*a* and 124*b*).

The feed lines 124 connect to feed transitions 128, such as feed transitions 128*a* and 128*b*. In at least one embodiment, the feed transitions 128 include solder joints that electrically connect to the feed lines 124, and then the electronics 102.

Probes 130 extend from the feed transitions 128 upwardly toward the patch 122. As described herein, in at least one embodiment, the probes 130 are T-shaped probes. The probes 130 are disposed within the internal cavity 112. In at least one embodiment, each probe 130 is supported on an inner cross wall 114 or an inner cross wall 116. As shown, the antenna assembly 100 includes a first probe 130*a* supported on an inner cross wall 114*a*, a second probe 130*b* supported on an inner cross wall 114*b*, a third probe 130*c* supported on an inner cross wall 116*a*, and a fourth probe 130*d* supported on an inner cross wall 116*b*. Optionally, the antenna assembly 100 may include more or less probes 130. For example, the antenna assembly 100 may include a single probe 130 supported on a single cross wall 114 or 116. As another example, the antenna assembly 100 may include one probe 130 supported on a cross wall 114, and another probe supported on a cross wall 116.

In at least one embodiment, the feed transitions 128 include the first feed transition 128*a* and the second feed transition 128*b*. The probes 130 (such as T-shaped probes 130) include a first T-shaped probe 130*a*, a second T-shaped probe 130*b*, a third T-shaped probe 130*c*, and a fourth T-shaped probe 130*d*. The cross walls 114, 116 include a first inner cross wall 114*a*, a second inner cross wall 114*b*, a third inner cross wall 116*a*, and a fourth inner cross wall 116*b*. The first T-shaped probe 130*a* is connected to the first feed transition 128*a* and the first inner cross wall 114*a*. The second T-shaped probe 130*b* is connected to the first feed transition 128*a* and the second inner cross wall 114*b*. The third T-shaped probe 130*c* is connected to the second feed transition 128*b* and the third inner cross wall 116*a*. The fourth T-shaped probe 130*d* is connected to the second feed transition 128*b* and the fourth inner cross wall 116*b*.

In at least one embodiment, the first inner cross wall 114*a* is parallel to the second inner cross wall 114*b*. The third inner cross wall 116*a* is parallel to the fourth inner cross wall 116*b*. The first and second inner cross walls 114*a*/114*b* are orthogonal (for example, perpendicular) to the third and fourth inner cross walls 116*a*/116*b*.

Each probe 130 includes a foot 132 secured within a feed transition 128. For example, the foot 132 can be soldered into the feed transition 128. The foot 132 may be or otherwise include a tab, for example. The foot 132 connects to an extension body 134, which, in turn, connects to an expanded head 136 (opposite from the foot 132), proximate to the support panel 120, thereby forming a T-shape.

Figure 7:
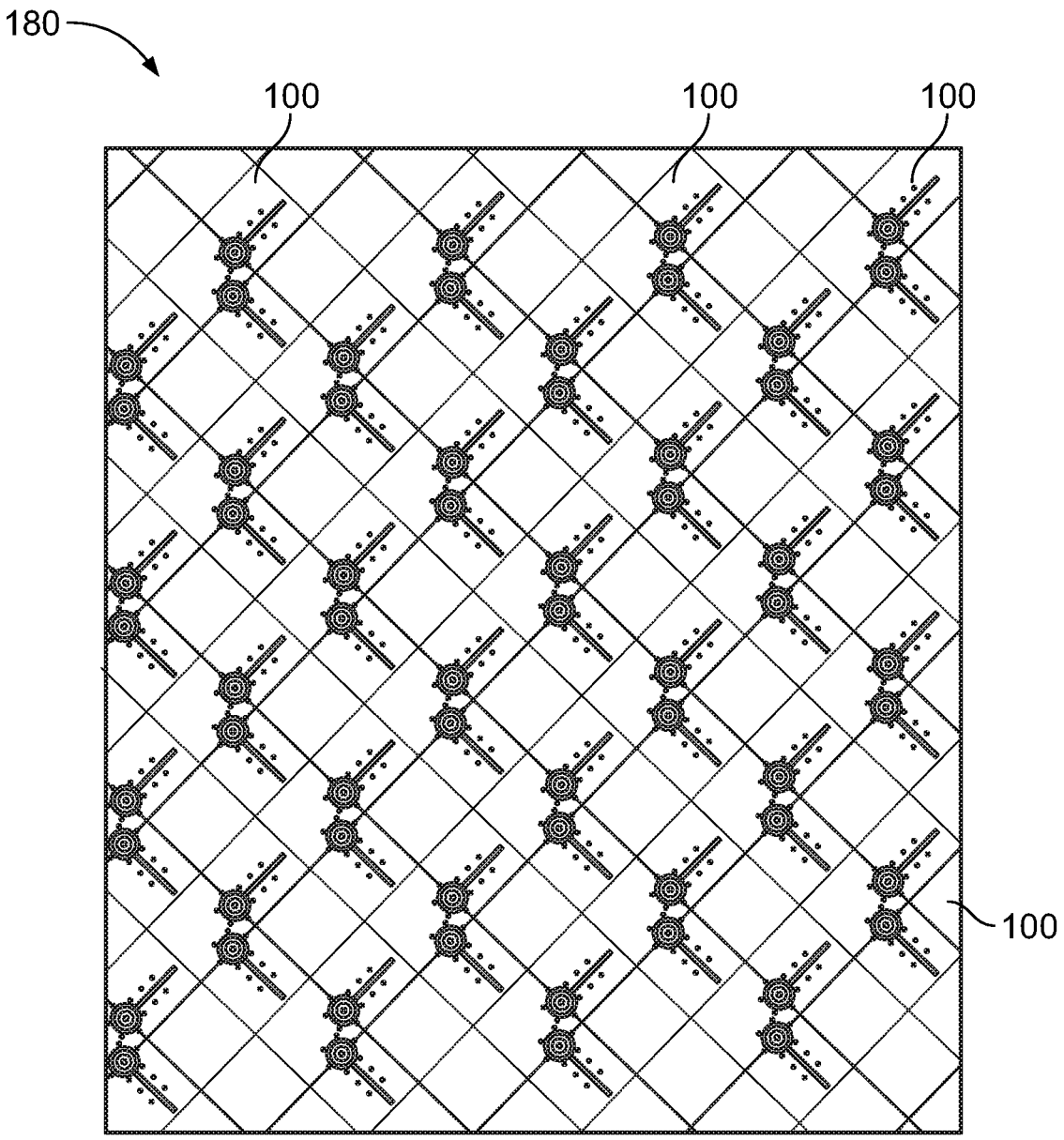
FIG. 7 illustrates a top view of an antenna array including a plurality of interconnected antenna assemblies, according to an embodiment of the present disclosure.

The position, length, and shape of the probes 130 and feed transitions 128 are tunable for impedance matching and orthogonal polarization isolation. The frame 123 provides an additional mechanism for tuning of impedance matching and control of mutual coupling with neighboring antenna elements (such as neighboring antenna assemblies 100 within an antenna array 180, as shown in FIG. 7). In at least one embodiment, the boundary of the antenna assembly 100 and the patch 122 may be square shaped, instead of rectangular, in order to maintain polarization balance and/or optimum axial ratio.

Figure 3:
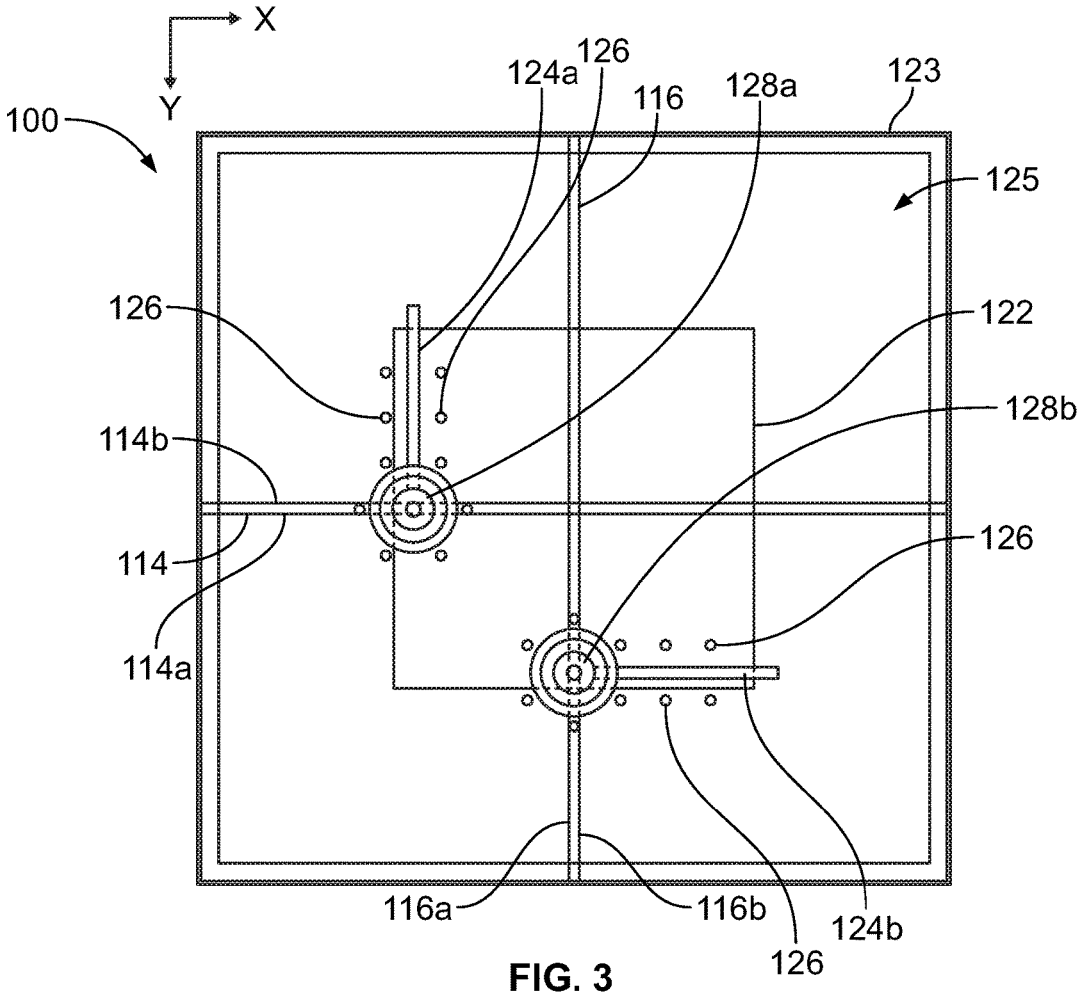
FIG. 3 illustrates a top view of the antenna assembly of FIG. 2.

FIG. 3 illustrates a top view of the antenna assembly 100 of FIG. 2. As shown, the antenna assembly 100 includes the feed line 124*a* and the feed line 124*b*, which are orthogonal to one another. The feed lines 124*a* and 124*b* couple to the electronics 102 (shown in FIG. 1) and to the probes 130 through the feed transitions 128*a* and 128*b*, respectively. Each feed transition 128*a* and 128*b* may support two probes 130. For example, referring to FIGS. 2 and 3, the feet 132 of the probes 130*a* and 130*b* are disposed within the feed transition 128*a*, and the feet 132 of the probes 130*c* and 130*d* are disposed within the feed transition 128*b*.

The dual feed lines 124*a* and 124*b*, as shown in FIGS. 2 and 3, allow for orthogonal polarization of the antenna assembly 100. Alternatively, the antenna assembly 100 can include just one of the feed lines 124*a* or 124*b* and one or more associated probes 130 to provide a single polarization.

Further, as noted, two probes 130 are coupled to each feed transition 128. By connecting two probes 130 to each feed transition, overall capacitance between the patch 122 and the expanded head 136 below is increased. The capacitance cancels the inductance caused by the feed probe 130 and thus improves antenna impedance matching. Alternatively, each feed transition 128 may connect to only one probe 130. For example, instead of two cross walls 114, a single cross wall 114*a* may support a single probe 130*a* that connects to the feed transition 128*a*.

The vias 126 are shorting vias that are positioned on sides of the feed lines 124*a* and 124*b*. The vias 126, as shorting vias, suppress undesirable parallel plate modes between two ground planes and isolate the feed line 124*a* from the feed line 124*b*, and vice versa, as well as provide a quasi-coaxial transition region. The antenna assembly 100 can include more or less vias 126 than shown, as desired.

The feed lines 124*a* and 124*b* are shown truncated in FIGS. 2 and 3. The feed lines 124*a* and 124*b* are configured to connect or otherwise couple to supporting electronics, such as amplifiers and power distribution circuits of neighboring antenna assemblies 100 (shown in FIG. 7).

In at least one embodiment, the horizontal dimensions (that is, with respect to the X-Y plane) may be chosen to meet desired scan angle requirements over a frequency band. In at least one embodiment, antenna assemblies 100 within an antenna array 180 (shown in FIG. 7) may have dimensions relative to wavelength at a highest operating frequency (depending on maximum beam scan angle requirements in elevation and azimuth), height of the internal cavity 112 and thicknesses of the base 104 and the support panel 120.

The base 104, the perimeter walls 110, the cross walls 114, and the cross walls 116 form a crate structure in an array setting. In at least one embodiment, the top section (including the support panel 120, the patch 122, and the frame 123) is fabricated separately from the bottom section (including the base 104, the perimeter walls 110, the cross walls 114, and the cross walls 116). The top and bottom sections may be bonded together during final assembly. Other methods of formation include using direct write technologies, bent/wrapped printed circuit boards, and flex circuit boards conformal to surfaces of structures, such as of vehicles.

Figure 4:
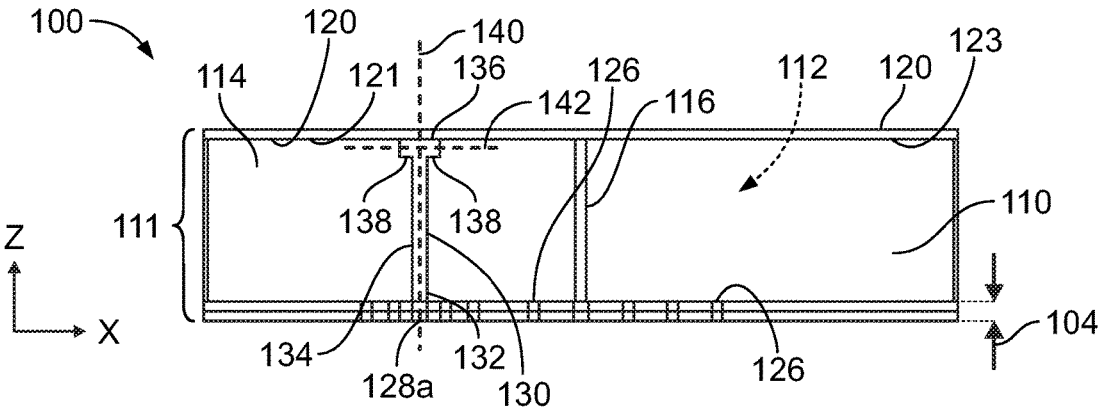
FIG. 4 illustrates an end view of the antenna assembly of FIG. 2.

FIG. 4 illustrates an end view of the antenna assembly 100 of FIG. 2. The patch 122 is hidden from view in FIG. 4, as the patch 122 may be axially contained within the internal opening 125 of the frame 123 (as shown in FIGS. 2 and 3).

The foot 132 of the probe 130 (such as the probe 130*a*, shown in FIG. 2) connects to the extension body 134, which, in turn, connects to the expanded head 136. The expanded head 136 is proximate to the support panel 120, but may be offset from a lower surface 121 of support panel 120 by a feed gap (shown in FIG. 6).

The expanded head 136 includes lateral extensions 138 that outwardly and laterally extend from the extension body 134. The extension body 134 has a longitudinal axis 140 that is perpendicular to a longitudinal axis 142 of the expanded head 136, thereby providing the probe 130 with a T shape.

The antenna assembly 100 has a thickness 111. As one example, the thickness 111 is approximately 0.2 wavelengths in free space at midband frequency.

Figure 5:
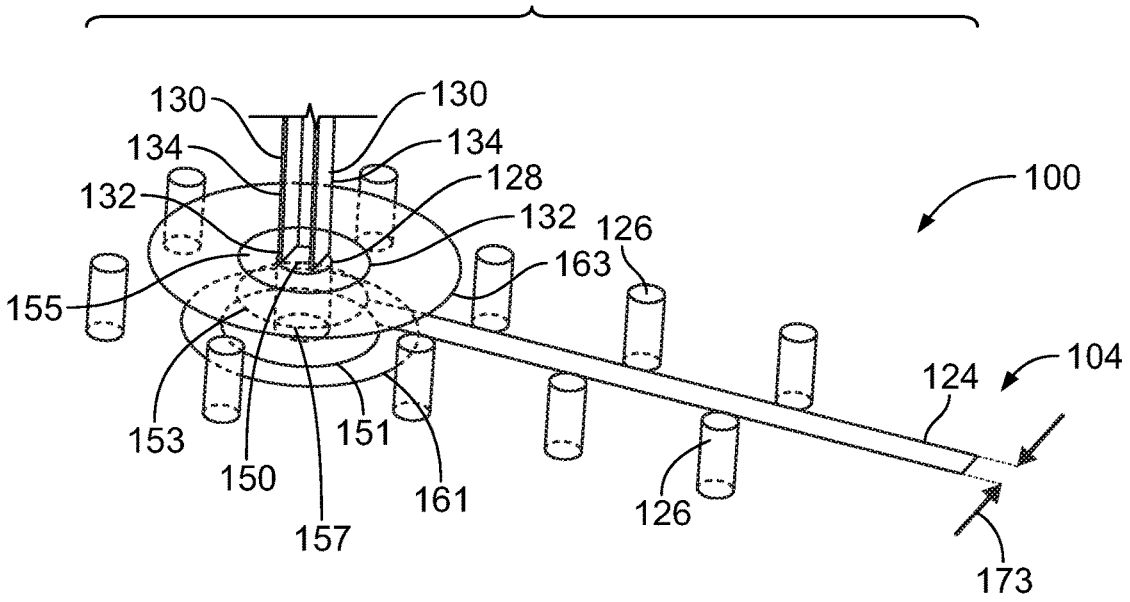
FIG. 5 illustrates a perspective top view of a feed transition within a base of the antenna assembly, according to an embodiment of the present disclosure.

FIG. 5 illustrates a perspective top view of the feed transition 128 within the base 104 of the antenna assembly 100, according to an embodiment of the present disclosure. The feet 132 of the probes 130 are disposed within a central channel 150 of the feed transition 128, and may be secured therein by solder. As such, the feed transition 128 may include a solder plug that securely couples the probes 130 to the feed transition 128.

The feed line 124 can be positioned over the base 104. Optionally, the feed line 124 can be embedded within the base 104.

As shown in FIG. 5, the feed transition 128 may include three copper pads 151, 153, and 155 radially extending from a central barrel 157. The pad 151 may reside within a first passage 161 (such as a cutout) formed within the base 104, and the pad 155 may reside within a second passage 163 (such as a cutout) formed within the base 104. The pads 151, 153, and 155, and the passages 161 and 163 are sized and shaped to yield a desired impedance matching over an operating frequency band.

The feed line 124 can be a stripline. A width 173 of the feed line 124 may be selected to provide a 50, 75, 100, or the like Ohm characteristic impedance. The feed line 124 extends and connects to the feed transition 128 and may be soldered to the feed transition 128.

Figure 6:
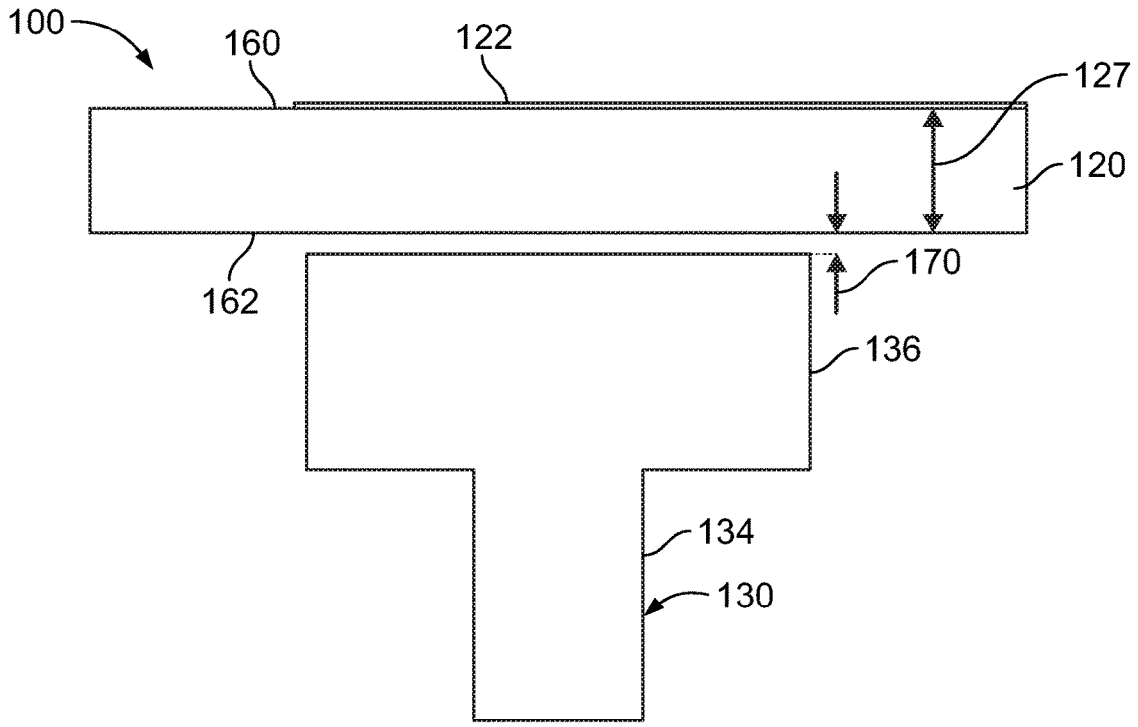
FIG. 6 illustrates a front view of a probe in relation to a support panel and a patch, according to an embodiment of the present disclosure.

FIG. 6 illustrates a front view of the probe 130 in relation to the support panel 120 and the patch 122, according to an embodiment of the present disclosure. As shown, the patch 122 may be supported on a first surface 160 (for example, a top surface, as shown in FIG. 6) of the support panel 120. The expanded head 136 of the probe 130 is proximate to an opposite second surface 162 (for example, a bottom surface, as shown in FIG. 6). The second surface 162 is opposite from the patch 122.

The expanded head 136 of the probe 130 is offset or otherwise separated from the support panel 120 by a feed gap 170. Alternatively, the expanded head 136 may connect to the second surface 162 of the support panel 120.

A thickness 127 for the support panel 120 is selected, as desired, and the size of the expanded head 136 and magnitude of the feed gap 170 is configured to provide sufficient capacitance to cancel inductance introduced by the feed probe 130. The T shape of the probe 130 provides balance between generating sufficient capacitance for impedance matching, while maintaining isolation with other orthogonal probes over an operating frequency band. The capacitive coupling between the probe 130 and the patch 122 eliminates, minimizes, or otherwise reduces a need to solder at the expanded head 136 during fabrication and/or formation of the antenna assembly 100.

FIG. 7 illustrates a top view of an antenna array 180 including a plurality of interconnected antenna assemblies 100, according to an embodiment of the present disclosure. Each antenna assembly 100 forms a unit cell in a periodic array. The antenna array 180 can include more or less antenna assemblies 100 than shown.

As shown, the antenna assemblies 100 may form identical unit cells in the antenna array 180. A feed distribution network and supporting electronics such as amplifiers are not shown, for clarity. The configuration of the antenna array 180 shown in FIG. 7 is optimized for one-dimensional scanning from left to right. Optionally, the antenna array 180 may include more or less antenna assemblies 100, which may be sized and shaped differently than shown. Further, the lattice structure of the antenna array 180 may be different than shown. For example, the lattice structure may be triangular, such as when used for two dimensional scanning.

Referring to FIGS. 1-7, certain embodiments of the present disclosure provide the antenna assembly 100, which includes the base 104 including one or more feed transitions 128, the support panel 120 separated from the base 104, the patch 122 secured to the support panel 120, and one or more T-shaped probes 130 that couple the feed transition(s) 128 to the patch 122. The T-shaped probe(s) 130 are separated from the patch 122. For example, the support panel 120 is disposed between the T-shaped probe(s) 130 and the patch 122. In at least one embodiment, the T-shaped probe(s) 130 are separated from the support panel 120 by the feed gap 170. In at least one embodiment, the base 104, the support panel 120, and/or the patch 122 are formed from one or more portions of one or more circuit boards.

Figure 8:
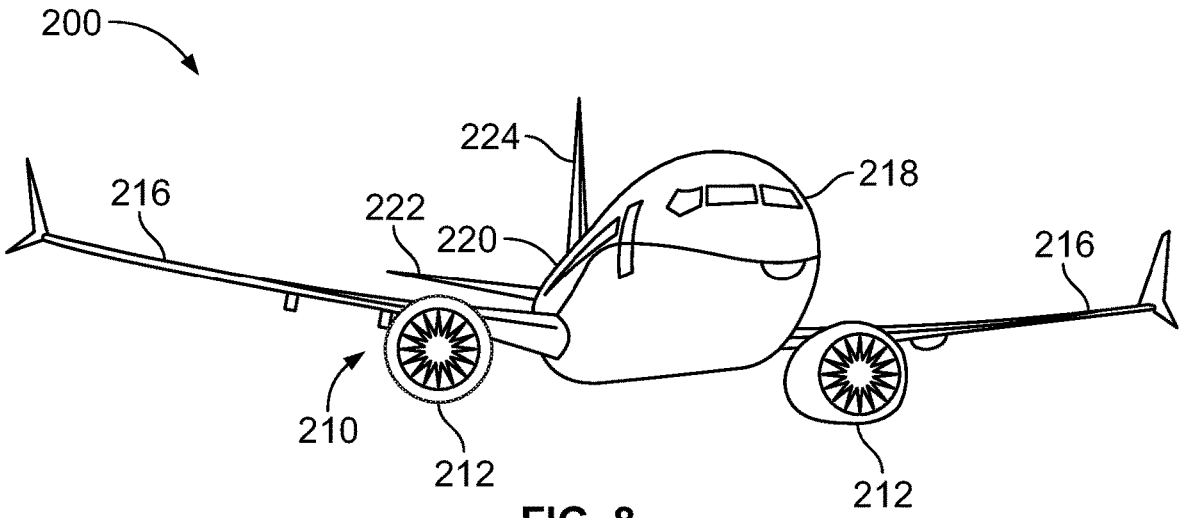
FIG. 8 illustrates a perspective front view of an aircraft.

FIG. 8 illustrates a perspective front view of an aircraft 200. The aircraft 200 may include one or more antenna assemblies 100 (shown in FIGS. 1-7), as described herein.

The aircraft 200 includes a propulsion system 210 that may include two engines 212, for example. Optionally, the propulsion system 210 may include more engines 212 than shown. The engines 212 are carried by wings 216 of the aircraft 200. In other embodiments, the engines 212 may be carried by a fuselage 218 and/or an empennage 220. The empennage 220 may also support horizontal stabilizers 222 and a vertical stabilizer 224. The wings 216, the horizontal stabilizers 222, and the vertical stabilizer 224 may each include one or more control surfaces.

Optionally, embodiments of the present disclosure may be used with respect to various other structures, such as other vehicles (including automobiles, watercraft, spacecraft, and the like), buildings, appliances, and the like.

Figure 9:
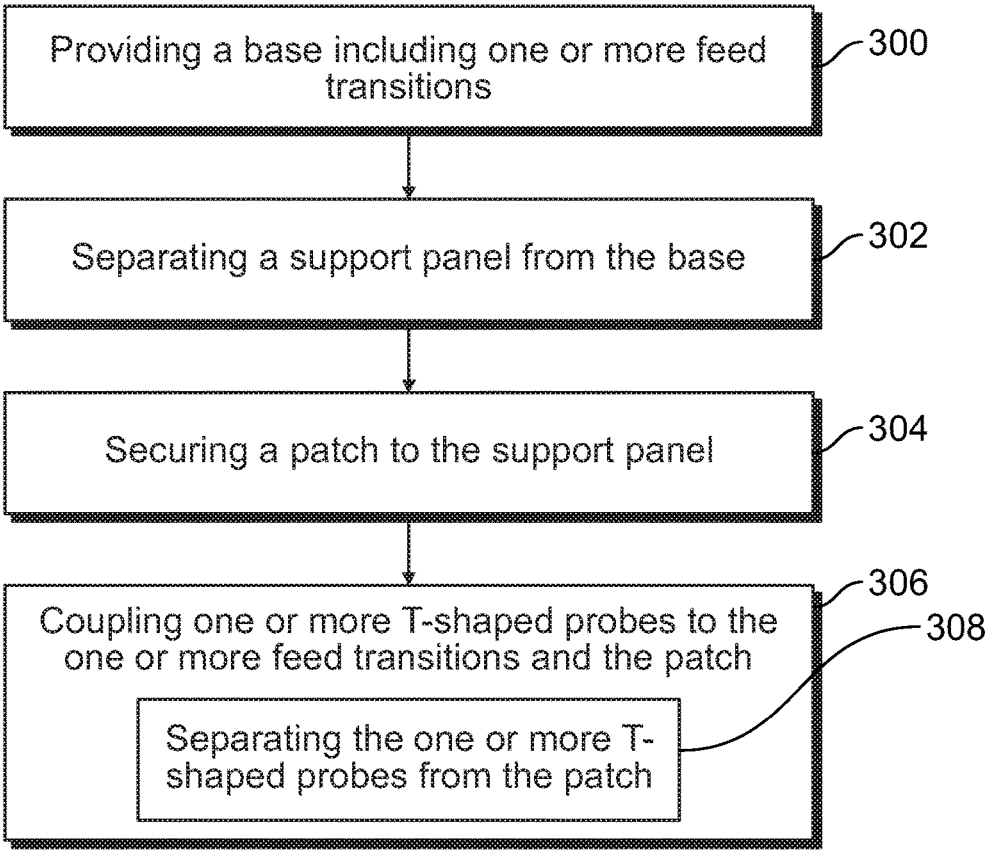
FIG. 9 illustrates a flow chart of a method of forming an antenna assembly, according to an embodiment of the present disclosure.

FIG. 9 illustrates a flow chart of a method of forming an antenna assembly, according to an embodiment of the present disclosure. The method includes providing (300) a base including one or more feed transitions; separating (302) a support panel from the base; securing (304) a patch to the support panel; and coupling (306) one or more T-shaped probes to the one or more feed transitions and the patch. The coupling (306) includes separating (308) the one or more T-shaped probes from the patch.

In at least one example, the coupling (306) further includes separating the one or more T-shaped from the support panel by a feed gap.

In at least one example, the method also includes forming one or more of the base, the support panel, and the patch from one or more portions of one or more circuit boards.

In at least one example, the method also includes disposing outer perimeter walls between the base and the support panel; defining an internal cavity between the outer perimeter walls, the base, and the support panel; and disposing the one or more T-shaped probes within the internal cavity.

In at least one example, the method also includes providing one or more inner cross walls within the internal cavity; and supporting the one or more T-shaped probes by the one or more inner cross walls.

In at least one example, the method also includes coupling a frame defining an internal opening to the support panel.

As described herein, embodiments of the present disclosure provide antenna assemblies that may be formed from lightweight, low-profile portions of circuit boards (such as sections of circuit boards), in contrast to relatively heavy and bulky slotted copper waveguide pipes. Embodiments of the present disclosure provide low-profile and lightweight antenna assemblies. Further, embodiments of the present disclosure provide electronically steerable antenna assemblies that can be effectively used with vehicles without reducing fuel efficiency and/or maneuverability. Also, embodiments of the present disclosure provide antenna assemblies that may be efficiently and effectively manufactured, in contrast to complex antennas having slotted copper waveguide pipes, which are typically formed through complex manufacturing processes.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

What is claimed is:

1. An antenna assembly, comprising:
a base including one or more feed transitions;
a support panel separated from the base;
a patch secured to the support panel;
one or more T-shaped probes that couple the one or more feed transitions to the patch; and
one or more support walls that support the one or more T-shaped probes, wherein the one or more T-shaped probes and the one or more support walls are separated from the patch.

2. The antenna assembly of claim 1, wherein the one or more T-shaped probes and the one or more support walls are separated from the support panel by a feed gap.

3. The antenna assembly of claim 1, wherein one or more of the base, the support panel, and the patch are formed from one or more portions of one or more circuit boards.

4. The antenna assembly of claim 1, wherein the patch is a microstrip patch supported on an upper surface of the support panel.

5. The antenna assembly of claim 1, further comprising a frame defining an internal opening, wherein the frame is coupled to the support panel.

6. The antenna assembly of claim 5, wherein the frame is formed from one or more portions of one or more circuit boards.

7. The antenna assembly of claim 1, further comprising outer perimeter walls disposed between the base and the support panel, wherein an internal cavity is defined between the outer perimeter walls, the base, and the support panel, and wherein the one or more T-shaped probes are disposed within the internal cavity.

8. The antenna assembly of claim 7, wherein the outer perimeter walls are formed from one or more portions of one or more circuit boards.

9. The antenna assembly of claim 8, wherein the one or more support walls are one or more inner cross walls within the internal cavity.

10. The antenna assembly of claim 9, wherein the one or more feed transitions comprise a first feed transition and a second feed transition, wherein the one or more T-shaped probes comprise a first T-shaped probe, a second T-shaped probe, a third T-shaped probe, and a fourth T-shaped probe, wherein the one or more inner cross walls comprise a first inner cross wall, a second inner cross wall, a third inner cross wall, and a fourth inner cross wall, wherein the first T-shaped probe is connected to the first feed transition and the first inner cross wall, wherein the second T-shaped probe is connected to the first feed transition and the second inner cross wall, wherein the third T-shaped probe is connected to the second feed transition and the third inner cross wall, and wherein the fourth T-shaped probe is connected to the second feed transition and the fourth inner cross wall.

11. The antenna assembly of claim 10, wherein the first inner cross wall is parallel to the second inner cross wall, wherein the third inner cross wall is parallel to the fourth inner cross wall, and wherein the first and second inner cross walls are orthogonal to the third and fourth inner cross walls.

12. The antenna assembly of claim 1, further comprising:
one or more feed lines coupled to the base and connected to the one or more feed transitions; and
one or more vias extending through the base proximate to the one or more feed lines.

13. The antenna assembly of claim 1, wherein the one or more T-shaped probes comprise:
a foot secured within the one or more feed transitions;
an extension body connected to the foot; and
an expanded head connected to the extension body opposite from the foot.

14. A method of forming an antenna assembly, the method comprising:
providing a base including one or more feed transitions;
separating a support panel from the base;
securing a patch to the support panel;
supporting one or more T-shaped probes on one or more support walls that are separated from the patch; and
coupling the one or more T-shaped probes to the one or more feed transitions and the patch, wherein said coupling comprises separating the one or more T-shaped probes from the patch.

15. The method of claim 14, wherein said coupling further comprises separating the one or more support walls and the one or more T-shaped probes from the support panel by a feed gap.

16. The method of claim 14, further comprising forming one or more of the base, the support panel, and the patch from one or more portions of one or more circuit boards.

17. The method of claim 14, further comprising:
disposing outer perimeter walls between the base and the support panel;
defining an internal cavity between the outer perimeter walls, the base, and the support panel; and
disposing the one or more T-shaped probes within the internal cavity.

18. The method of claim 17, further comprising providing the one or more support walls as one or more inner cross walls within the internal cavity.

19. The method of claim 14, further comprising coupling a frame defining an internal opening to the support panel.

20. An antenna assembly, comprising:
a base including one or more feed transitions;
one or more feed lines coupled to the base and connected to the one or more feed transitions;
one or more vias extending through the base proximate to the one or more feed lines;
a support panel separated from the base;
a frame defining an internal opening, wherein the frame is coupled to the support panel;
a patch secured to the support panel;
outer perimeter walls disposed between the base and the support panel, wherein an internal cavity is defined between the outer perimeter walls, the base, and the support panel;
one or more inner cross walls within the internal cavity; and
one or more T-shaped probes that couple the one or more feed transitions to the patch, wherein the one or more cross walls and the one or more T-shaped probes are separated from the patch, wherein the one or more cross walls and the one or more T-shaped probes are separated from the support panel by a feed gap, wherein the one or more T-shaped probes are disposed within the internal cavity, wherein the one or more T-shaped probes are supported by the one or more inner cross walls, wherein the one or more T-shaped probes comprise: (a) a foot secured within the one or more feed transitions, (b) an extension body connected to the foot, and (c) an expanded head connected to the extension body opposite from the foot;

wherein the base, the support panel, the frame, the patch, the outer perimeter walls, and the one or more inner cross walls are formed from one or more portions of one or more circuit boards.

* * * * *